US009302864B2

(12) United States Patent
Yamaguchi

(10) Patent No.: US 9,302,864 B2
(45) Date of Patent: Apr. 5, 2016

(54) SHEET CONVEYING DEVICE, AND IMAGE FORMING APPARATUS INCLUDING THE SAME

(71) Applicant: KYOCERA Document Solutions Inc., Osaka-shi, Osaka (JP)

(72) Inventor: Yoshihiro Yamaguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/692,549

(22) Filed: Apr. 21, 2015

(65) Prior Publication Data

US 2015/0307297 A1 Oct. 29, 2015

(30) Foreign Application Priority Data

Apr. 24, 2014 (JP) ..... 2014-089930

(51) Int. Cl.
*B65H 1/28* (2006.01)
*B65H 1/04* (2006.01)

(52) U.S. Cl.
CPC .. *B65H 1/28* (2013.01); *B65H 1/04* (2013.01); *B65H 2402/441* (2013.01); *B65H 2405/331* (2013.01); *B65H 2405/3311* (2013.01)

(58) Field of Classification Search
CPC ..... B65H 1/28; B65H 2402/441; B65H 2405/331; B65H 2405/3311
See application file for complete search history.

(56) References Cited

U.S. PATENT DOCUMENTS 6,695,303 B2 * 2/2004 Okada ..... B65H 1/266 271/164
8,047,540 B2 * 11/2011 Daigo et al. ..... B65H 1/266 271/264
2002/0130458 A1 * 9/2002 Okada ..... B65H 1/266 271/912
2011/0062649 A1 * 3/2011 Ichikawa ..... B65H 1/28 271/9.01

FOREIGN PATENT DOCUMENTS

JP 09020434 A 1/1997

* cited by examiner

*Primary Examiner* — Jeremy R Severson
(74) *Attorney, Agent, or Firm* — Alleman Hall McCoy Russell & Tuttle LLP

(57) ABSTRACT

An image forming apparatus includes first and second sheet feed cassettes and the like. When a lift plate and sheets thereon are raised in the first sheet feed cassette, causing a pick-up roller to move upward, an arm member is inclined upward from a holder side toward a lever member side. The lever member is raised by the arm member on a second flat plate portion to be in a horizontal attitude, and a vertical wall faces a vertical wall portion of the first sheet feed cassette across a predetermined gap. As a result, when the first sheet feed cassette is pulled out to a certain extent, the vertical wall of the lever member abuts on the vertical wall portion of the first sheet feed cassette, and a conveyance unit is pulled out together with the first sheet feed cassette.

8 Claims, 10 Drawing Sheets

SHEET CONVEYING DEVICE, AND IMAGE FORMING APPARATUS INCLUDING THE SAME

INCORPORATION BY REFERENCE

This application is based upon and claims the benefit of priority from the corresponding Japanese Patent Application No. 2014-089930 filed on Apr. 24, 2014, the entire contents of which are incorporated herein by reference.

BACKGROUND

The present disclosure relates to a sheet conveying device in which a plurality of sheet feed cassettes are disposed in alignment in the sheet conveyance direction, and to an image forming apparatus including the sheet conveying device.

Conventionally, there has been known an image forming apparatus including two sheet feed cassettes that can be inserted into and pulled out from the apparatus main body in the same direction independently of each other. The two sheet feed cassettes are disposed in alignment in a direction perpendicular to a direction in which the sheet feed cassettes are inserted and pulled out. This type of image forming apparatus is configured to supply sheets stored in the sheet feed cassettes to the image forming portion, from a position near a side surface of the apparatus on the side of one of the sheet feed cassettes. In that case, a sheet conveyance path is formed between the one sheet feed cassette and the image forming portion. In addition, the image forming apparatus includes a conveyance unit for conveying sheets stored in the other sheet feed cassette to the sheet conveyance path.

In this type of image forming apparatus, it may happen that a sheet feed cassette is pulled out at a timing when a sheet stretches over the sheet feed cassette and the conveyance unit. In that case, if only the sheet feed cassette is pulled out, the sheet would be torn apart. As a result, the sheet feed cassette and the conveyance unit may be configured to be pulled out together. Specifically, the conveyance unit is provided with an arm connected with an iron core of a solenoid, the sheet feed cassette is provided with a lock plate, and the arm is engaged with the lock plate by actuating the solenoid. With this configuration, the conveyance unit and the sheet feed cassette are pulled out together.

SUMMARY

A sheet conveying device according to an aspect of the present disclosure includes a device main body, a first sheet feed cassette, a second sheet feed cassette, a conveyance unit, a feed roller, a lift plate, a lifting portion, an interruption portion, and an actuator member. The first sheet feed cassette is configured to feed a sheet stored therein in a sheet feed direction in which the sheet is fed to the device main body and be inserted to and pulled out from the device main body in an insertion/pulling-out direction which intersects with the sheet feed direction. The second sheet feed cassette is disposed in alignment with the first sheet feed cassette on a downstream side thereof in the sheet feed direction and configured to be inserted into and pulled out independently from the device main body in the insertion/pulling-out direction. The conveyance unit is disposed above the first sheet feed cassette and the second sheet feed cassette in the device main body and configured to be inserted into and pulled out independently of the first sheet feed cassette and the second sheet feed cassette in the insertion/pulling-out direction and convey a topmost sheet of the sheets stored in the first sheet feed cassette toward a sheet conveyance path that is provided more on the downstream side in the sheet conveyance direction than the second sheet feed cassette. The feed roller is provided in the conveyance unit in such a way as to be displaced above the sheets stored in the first sheet feed cassette and feed the topmost sheet to the conveyance unit. The lift plate has a sheet stacking surface on which the sheets stored in the first sheet feed cassette are placed, and is configured to be raised and lowered between an upper position and a lower position, wherein when the lift plate is at the upper position, the sheets on the lift plate abut on the feed roller and the feed roller is allowed to feed the sheet, and when the lift plate is at the lower position, the sheets on the lift plate are separated from the feed roller. The lifting portion is configured to raise and lower the lift plate between the upper position and the lower position. The interruption portion is projecting from an upper part of the first sheet feed cassette. The actuator member is provided in the conveyance unit and configured to be displaced between a first position and a second position in conjunction with displacement of the feed roller, wherein the actuator member at the first position is allowed to interrupt with the interruption portion, and the actuator member at the second position is separated from the interruption portion. The conveyance unit is configured such that when the conveyance unit is pulled out in a state where the actuator member is at the first position, the actuator member and the interruption portion interrupt with each other, and the conveyance unit is pulled out together with the first sheet feed cassette, and when the conveyance unit is pulled out in a state where the actuator member is at the second position, the actuator member does not interrupt with the interruption portion, and the conveyance unit is pulled out independently of the first sheet feed cassette.

An image forming apparatus according to another aspect of the present disclosure includes the sheet conveying device and an image forming portion. The image forming portion forms an image based on a sheet conveyed by the sheet conveying device from the first sheet feed cassette or the second sheet feed cassette.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the invention. It should be noted that the following description is an example of a specific embodiment of the present invention and should not limit the technical scope of the invention.

Figure 1:
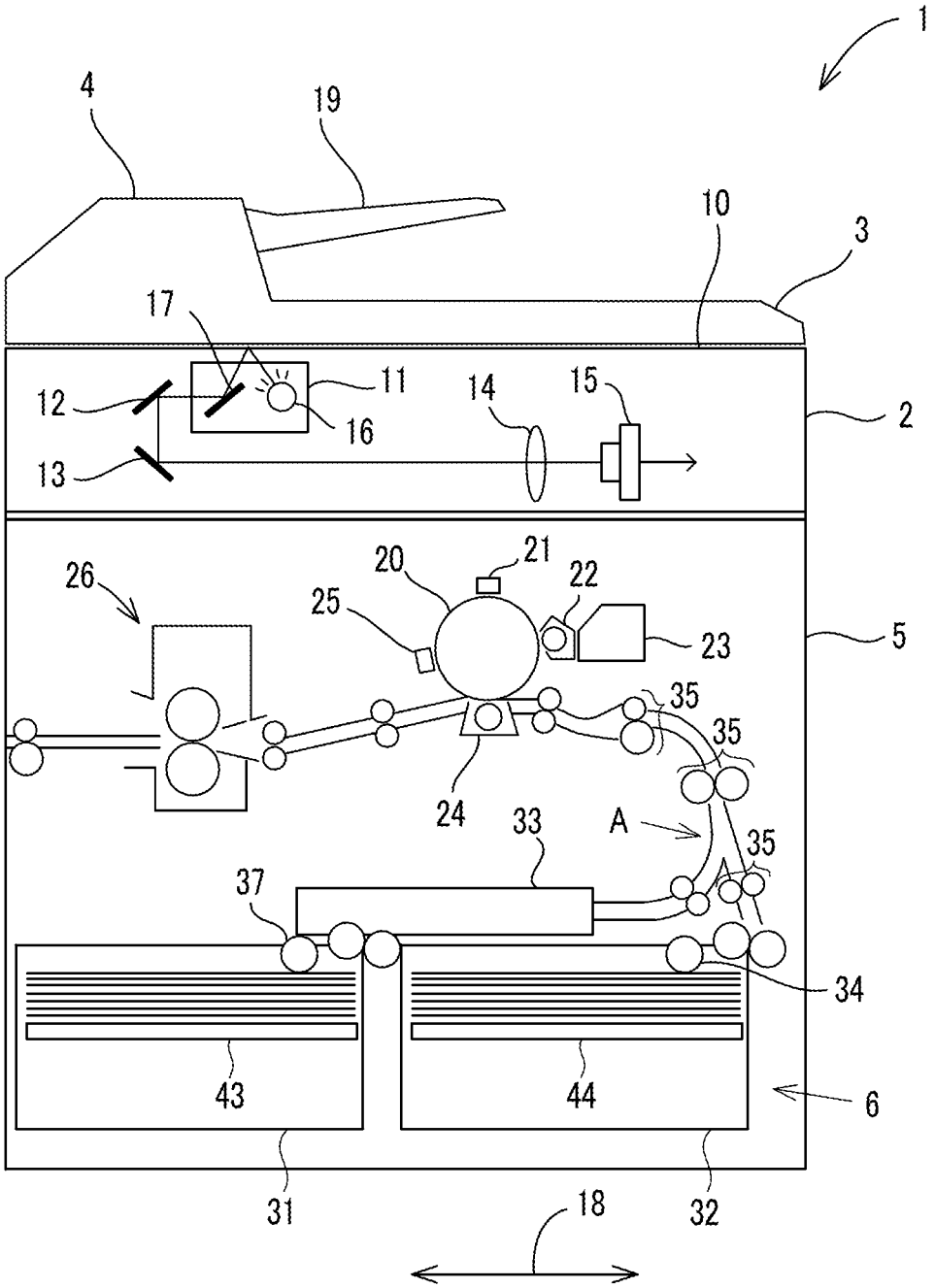
FIG. 1 is a schematic diagram showing the internal configuration of an image forming apparatus according to an embodiment of the present disclosure.

An image forming apparatus 1 according to an embodiment of the present disclosure is a multifunction peripheral having an image reading function, a facsimile function, an image forming function and the like. As shown in FIG. 1, the image forming apparatus 1 includes an image reading portion 2, a document sheet cover 3, an ADF (Automatic Document Feeder) 4, an image forming portion 5, and a sheet feed portion 6. The sheet feed portion 6 is an example of the sheet conveying device of the present disclosure. It is noted that although in the following, the image forming apparatus 1 which is a multifunction peripheral is described as one example, the present disclosure is not limited to that. For example, the image forming apparatus of the present disclosure may be a printer, a facsimile apparatus, or a copier. In the following description, a direction perpendicular to the plane of FIG. 1 is referred to as a front-rear direction, the front side on the plane is referred to as a front side, and the depth side on the plane is referred to as a rear side.

The image reading portion 2 executes an image reading process of reading image data from the document sheet. As shown in FIG. 1, the image reading portion 2 includes a contact glass 10, a reading unit 11, mirrors 12 and 13, an optical lens 14, and a CCD (Charge Coupled Device) 15.

The reading unit 11 includes an LED light source 16 and a mirror 17, and is configured to be movable in a sub scanning direction 18 (the left-right direction in FIG. 1) by a moving mechanism (not shown) using a driving motor such as a stepping motor. While the reading unit 11 is being moved in the sub scanning direction 18 by the driving motor, light is irradiated from the LED light source 16 toward the contact glass 10, and the light is scanned in the sub scanning direction 18.

In the image reading portion 2, the document sheet cover 3 is provided in such a way as to be rotationally moved. With the rotational movement of the document sheet cover 3, the contact glass 10 on the upper surface of the image reading portion 2 is opened and closed.

The image reading portion 2 reads an image from a document sheet in the following procedure. First, a document sheet is placed on the contact glass 10, and the document sheet cover 3 is closed. Subsequently, when an image reading instruction is input, the reading unit 11 is moved rightward in the sub scanning direction 18, while a line of light is continually irradiated from the LED light source 16. Light reflected on the document sheet or the rear surface of the document sheet cover 3 is guided into the CCD 15 via the mirrors 17, 12 and 13 and the optical lens 14. Subsequently, light amount data which corresponds to the amount of light received by the CCD 15 is output in sequence from the CCD 15 to a control portion (not shown). Upon obtaining the light amount data of the whole area on which the light was irradiated, the control portion generates the image data of the document sheet from the light amount data by processing the light amount data.

The ADF 4 is provided in the document sheet cover 3. The ADF 4 conveys a document sheet set on a document sheet setting portion 19, by a plurality of conveyance rollers. The ADF 4 conveys the document sheet so as to pass an automatic document sheet reading position provided on the contact glass 10, moving rightward in the sub scanning direction 18. In the case where the document sheet is conveyed by the ADF 4, the reading unit 11 is disposed below the automatic document sheet reading position, and the image of the document sheet is read by the reading unit 11 at this position.

As shown in FIG. 1, the image forming portion 5 executes an image forming process (print process) by the electrophotography. The image forming portion 5 executes the image forming process based on image data which has been read by the image reading portion 2, or based on a print job input from an external information processing apparatus such as a personal computer. The image forming portion 5 includes a photoconductor drum 20, a charging portion 21, a developing portion 22, a toner container 23, a transfer roller 24, an electricity removing portion 25, a fixing device 26 and the like. It is noted that although the electrophotographic image forming portion 5 is described as one example, the image forming portion 5 is not limited to the electrophotography, but may use an inkjet recording method or other recording or printing methods.

In the image forming portion 5, an image forming process of forming an image on a sheet supplied from the sheet feed portion 6 is performed in the following procedure. First, when a print job including a print instruction is input from an external apparatus, the charging portion 21 charges the surface of the photoconductor drum 20 uniformly to a certain potential. Next, a laser scanning unit (not shown) irradiates the surface of the photoconductor drum 20 with light based on the image data included in the print job. With this operation, an electrostatic latent image is formed on the surface of the photoconductor drum 20. The electrostatic latent image on the photoconductor drum 20 is developed (visualized) as a toner image by the developing portion 22. It is noted that the toner (developer) is supplied to the developing portion 22 from the toner container 23. Subsequently, the toner image formed on the photoconductor drum 20 is transferred to the sheet by the transfer roller 24. After the transfer, the potential of the photoconductor drum 20 is removed by the electricity removing portion 25. Subsequently, the toner image transferred to the sheet is heated so as to be fused and fixed to the sheet when the sheet is passed through the fixing device 26, and the sheet is discharged.

Figure 2:
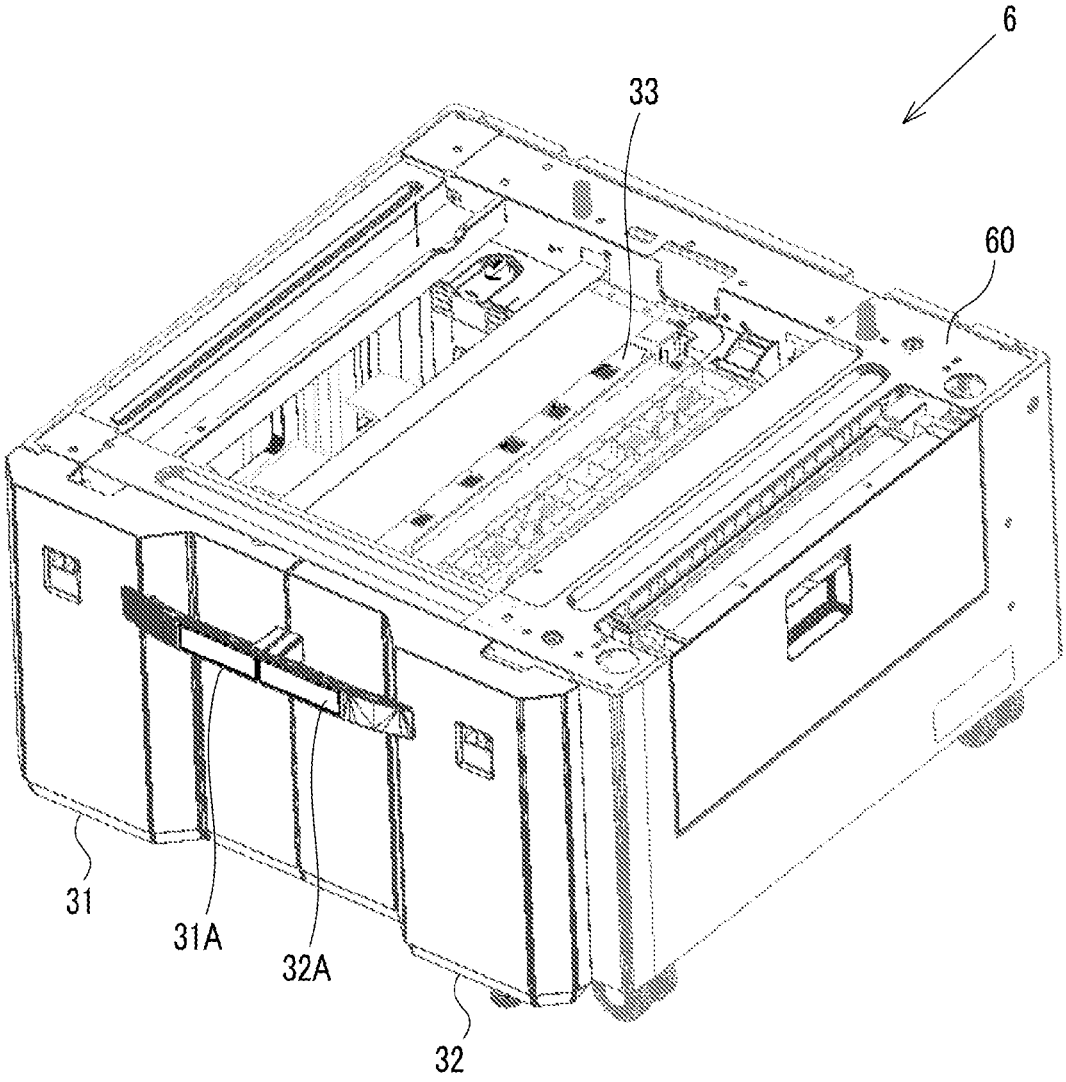
FIG. 2 is an outer appearance perspective view of a sheet feed portion which is an example of a sheet conveyance device according to an embodiment of the present disclosure.

The sheet feed portion 6 is provided in a lower part of the image forming apparatus 1. The sheet feed portion 6 stores sheets which are to be conveyed toward the photoconductor drum 20. As shown in FIG. 2, the sheet feed portion 6 includes a first sheet feed cassette 31, a second sheet feed cassette 32, and a conveyance unit 33, in a frame body which is composed of a frame 60 (device main body).

Figure 3A:
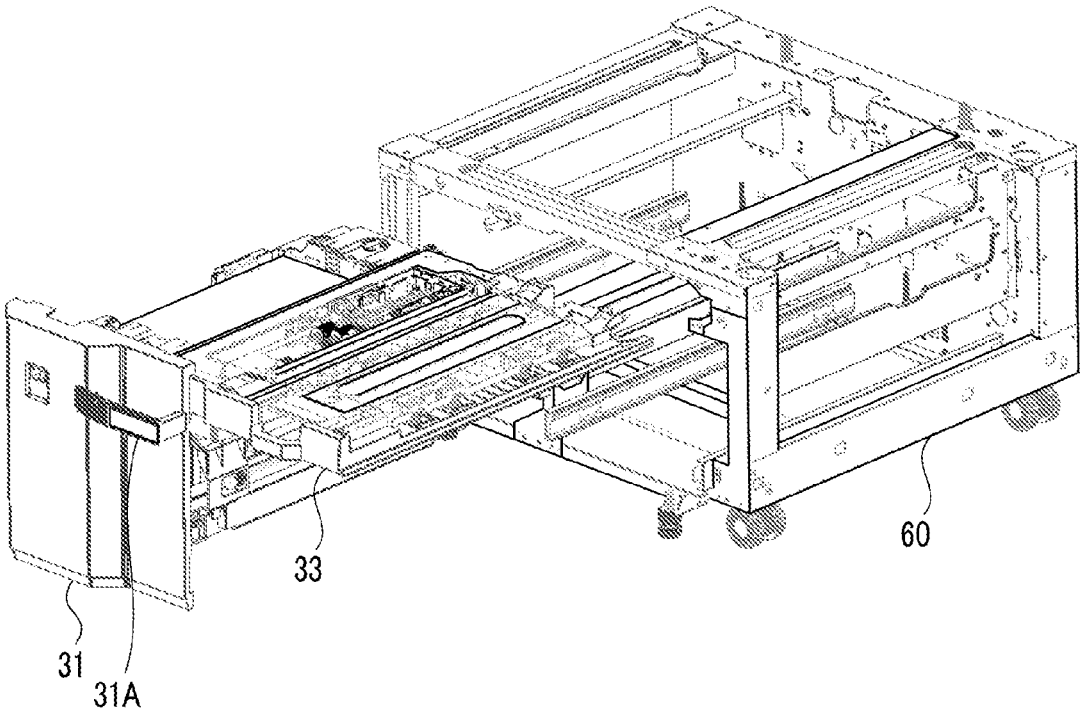
FIG. 3A is a diagram showing the state where both a first sheet feed cassette and a conveyance unit are pulled out.
Figure 3B:
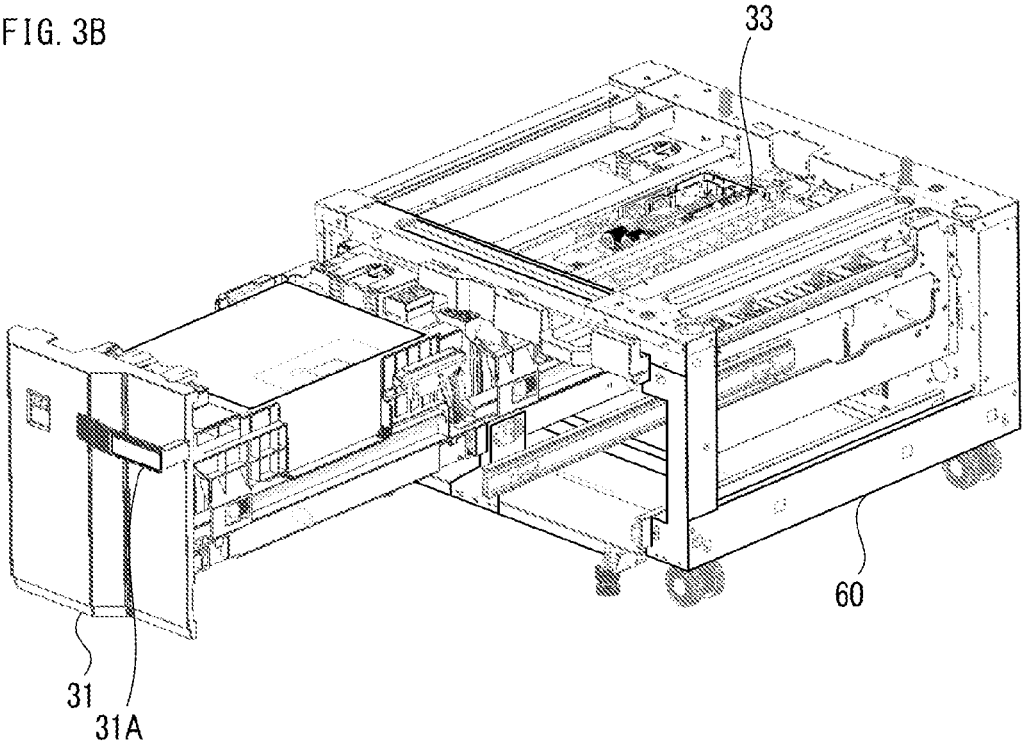
FIG. 3B is a diagram showing the state where only the first sheet feed cassette is pulled out.

The first sheet feed cassette 31 and the second sheet feed cassette 32 are disposed in alignment in the sub scanning direction 18. A handle 31A is provided on the front surface of the first sheet feed cassette 31, and a handle 32A is provided on the front surface of the second sheet feed cassette 32. As shown in FIGS. 3A and 3B, the first sheet feed cassette 31 is configured to be inserted into and pulled out from the frame 60 in the front-rear direction of the image forming apparatus 1, with the operation of the handle 31A by the user. The front-rear direction is a direction perpendicular to the sub scanning direction 18 in a plane that is parallel to a plane on which the image forming apparatus 1 is installed. Although not shown in FIGS. 3A and 3B, as in the first sheet feed cassette 31, the second sheet feed cassette 32 is also configured to be inserted into and pulled out from the frame 60 in the front-rear direction, with the operation of the handle 32A by the user.

As shown in FIG. 1, the sheets stored in the first sheet feed cassette 31 are conveyed rightward above the second sheet feed cassette 32, and then conveyed in an approximately vertical direction from a position close to the right-side surface of the image forming apparatus 1 toward the image forming portion 5. In addition, the sheets stored in the second sheet feed cassette 32 are conveyed in an approximately vertical direction from a position that is on the second sheet feed cassette 32 side and close to the right-side surface of the image forming apparatus 1 toward the image forming portion 5. That is, the second sheet feed cassette 32 is more on the downstream side in the sheet conveyance direction than the first sheet feed cassette 31.

The first sheet feed cassette 31 includes a lift plate 43, and the second sheet feed cassette 32 includes a lift plate 44. The lift plates 43 and 44 have sheet stacking surfaces on which sheets stored in the first sheet feed cassette 31 and the second sheet feed cassette 32 are placed, respectively. The lift plates 43 and 44 are configured to be raised and lowered by a driving motor 51 (see FIG. 10).

A pick-up roller 34 is provided in the second sheet feed cassette 32. The pick-up roller 34 feeds, one by one from above, the sheets stored in the second sheet feed cassette 32. The fed sheet is conveyed to the image forming portion 5 by pairs of conveyance rollers 35.

The conveyance unit 33 is disposed above the first sheet feed cassette 31 and the second sheet feed cassette 32. The conveyance unit 33 feeds sheets stored in the first sheet feed cassette 31 and conveys the sheets toward the downstream side in the sheet conveyance direction. Specifically, the conveyance unit 33 conveys the sheets into a sheet conveyance path A (see FIG. 1) that is formed between the image forming portion 5 and the second sheet feed cassette 32.

The conveyance unit 33 can be moved independently of the first sheet feed cassette 31 and the second sheet feed cassette 32, in an insertion/pulling-out direction in which the first sheet feed cassette 31 and the second sheet feed cassette 32 are inserted and pulled out. As shown in FIG. 3A, the conveyance unit 33 is configured to be pulled out from the frame 60 together with the first sheet feed cassette 31 when the first sheet feed cassette 31 is pulled out. The configuration is described below.

Figure 4:
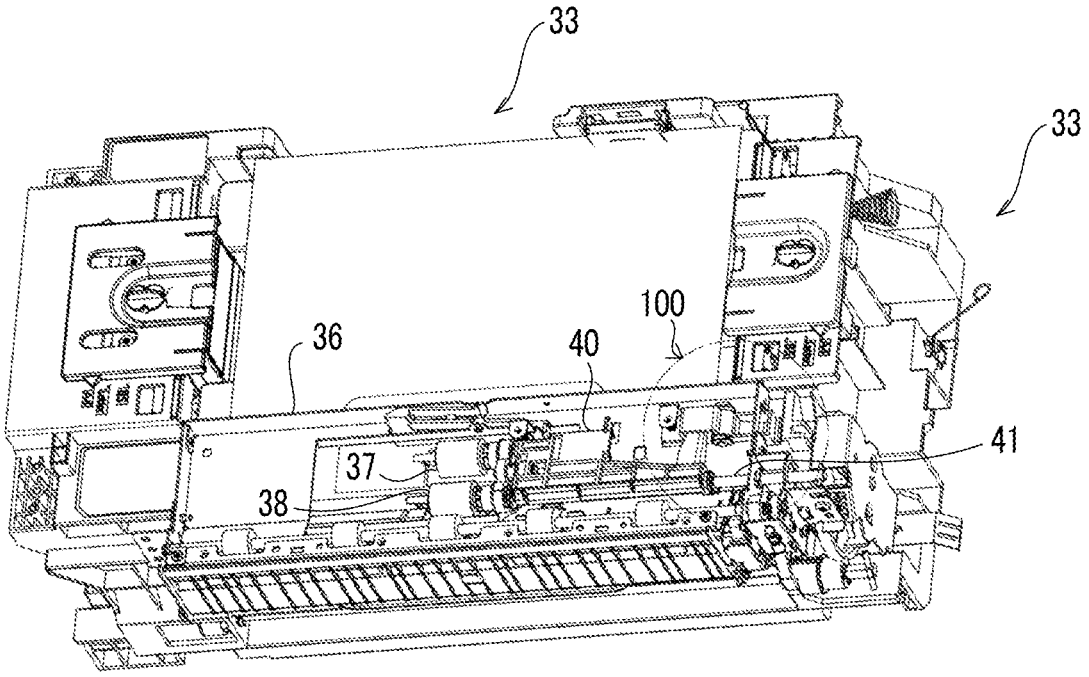
FIG. 4 is an outer appearance perspective view of a part of the conveyance unit and the first sheet feed cassette.
Figure 5:
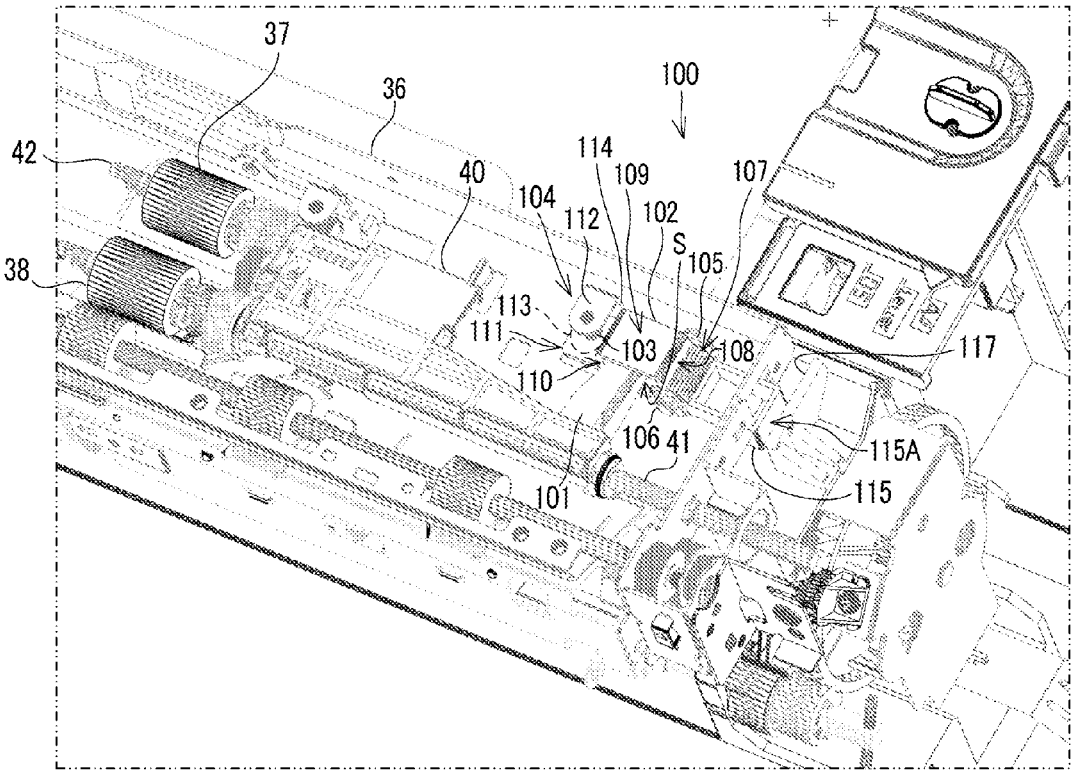
FIG. 5 is an outer appearance perspective view of a part of the conveyance unit.

As shown in FIGS. 4 and 5, the conveyance unit 33 includes a housing 36. It is noted that in FIGS. 4 and 5, only a part of the conveyance unit 33 that is positioned above the first sheet feed cassette 31 is shown. The conveyance unit 33 includes a pick-up roller 37, a sheet feed roller 38, a separation roller 39 (see FIGS. 6A and 6B), and a holder 40. As shown in FIGS. 1 and 4, the members 37 through 40 are provided in the housing 36, above an end portion of the first sheet feed cassette 31 on the downstream side in the sheet conveyance direction.

As shown in FIG. 5, a rotation shaft 41 is provided along the front-rear direction of the housing 36 (the insertion/pulling-out direction of the conveyance unit 33). The rotation shaft 41 is rotatably supported by the housing 36. The rotation shaft 41 is rotationally driven by a driving motor (not shown) that is provided in the frame 60 (see FIGS. 3A and 3B). A sheet feed roller 38 is rotatably attached to the rotation shaft 41. In addition, the holder 40 is loosely fitted to the rotation shaft 41. Parallel to the rotation shaft 41, a rotation shaft 42 is rotatably attached to an end portion of the holder 40 on the upstream side. The rotation shaft 42 is rotationally driven by a driving motor (not shown). The pick-up roller 37 is rotatably attached to the rotation shaft 42.

Figure 6A:
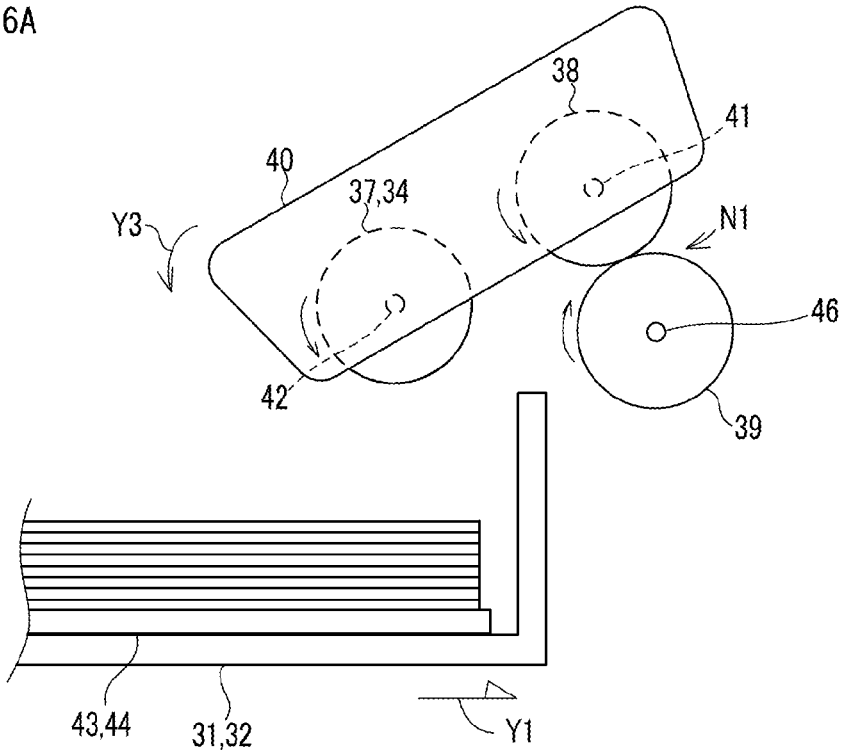
FIG. 6A is a diagram showing the configuration of a portion that feeds a sheet from a sheet feed cassette.
Figure 6B:
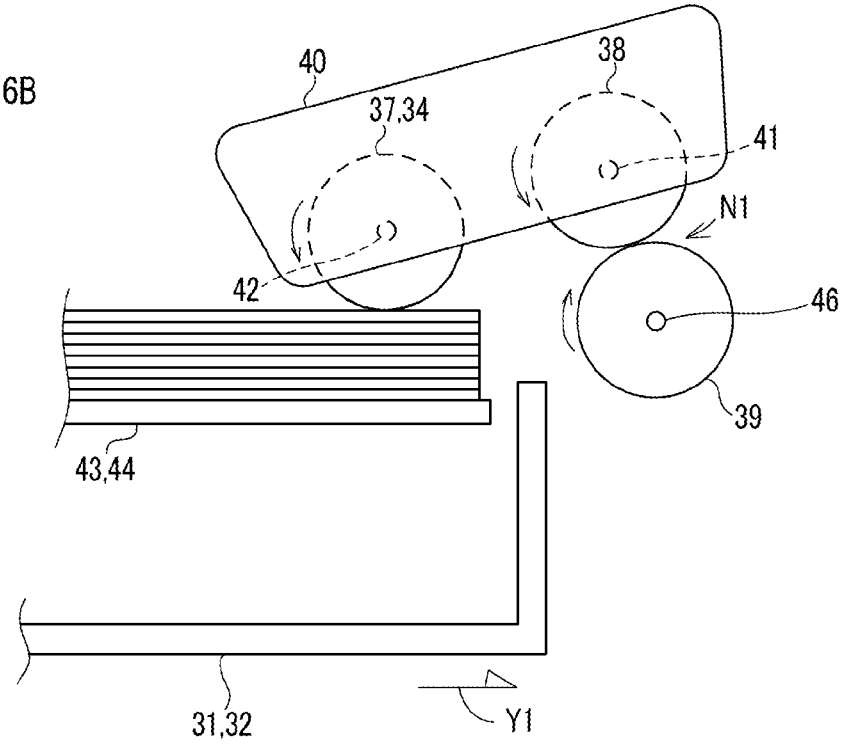
FIG. 6B is a diagram showing the state where a pick-up roller has been dislocated from a position in the state shown in FIG. 6A due to the upward movement of the lift plate.

As shown in FIGS. 6A and 6B, the pick-up roller 37 comes into contact with an uppermost sheet among the sheets raised by the lift plate 43, and is rotated in a predetermined direction (forward rotation) so as to feed the sheet that is in contact with it.

The sheet feed roller 38 is provided more on the downstream side in the sheet feed direction than the pick-up roller 37. The sheet feed roller 38 nips a sheet in a nip portion N1 that is formed between the sheet feed roller 38 and the separation roller 39, and conveys the sheet toward the downstream side in the sheet conveyance direction while nipping the sheet.

The separation roller 39, together with the sheet feed roller 38, nips the sheet fed by the pick-up roller 37. Upon receiving a load that is equal to or larger than a predetermined set value, the separation roller 39 rotates following the rotation of the sheet feed roller 38. The set value is set to a value of the load that is imposed on the separation roller 39 when two or more overlapping sheets are fed. When a plurality of sheets are fed in the overlapping state by the pick-up roller 37, the separation roller 39 separates the uppermost sheet from the other sheets. This allows the sheets to to be conveyed one by one toward the image forming portion 5 by the sheet feed roller 38 and the separation roller 39.

The pick-up roller 37 and the sheet feed roller 38 are supported by the holder 40. The holder 40 rotatably supports the pick-up roller 37 and the sheet feed roller 38. As described above, the holder 40 is loosely fitted to the rotation shaft 41, and the rotation shaft 41 is rotatably supported by the housing 36. When the lift plate 43 rises, the sheets in the first sheet feed cassette 31 rise, and the pick-up roller 37 is raised upward by the sheets. At this time, the holder 40 sways around the rotation shaft 41, and takes an attitude in correspondence with the position of the pick-up roller 37 (see FIG. 6B). When the lift plate 43 is lowered, the sheets in the first sheet feed cassette 31 are lowered, and the pick-up roller 37 is lowered to a predetermined position. The pick-up roller 37 then stops at the position, but the sheets are further lowered. As a result, the sheets in the first sheet feed cassette 31 are separated from the pick-up roller 37. At this time, the holder 40 sways in the direction indicated by the arrow Y3, and takes an attitude corresponding to the position of the pick-up roller 37 (see FIG. 6A). The holder 40 sways between these two attitudes.

A pick-up roller 34 is provided in the frame 60, wherein the pick-up roller 34 operates in the second sheet feed cassette 32 in the same manner as the pick-up roller 37. In addition, members that operates in the second sheet feed cassette 32 in the same manner as the sheet feed roller 38, separation roller 39, and holder 40 are provided in the frame 60. It is noted that in FIGS. 6A and 6B, the members that operates in the second sheet feed cassette 32 are assigned the same reference numbers as the sheet feed roller 38, separation roller 39, and holder 40.

In the first sheet feed cassette 31 and the second sheet feed cassette 32, the lift plates 43 and 44 are provided so as to reciprocally move in the up-down direction of FIG. 1. Sheets stored in the first sheet feed cassette 31 are placed on the lift plate 43, and sheets stored in the second sheet feed cassette 32 are placed on the lift plate 44.

The lift plates 43 and 44 are driven by the driving motor 51 (see FIG. 10) to be raised and lowered between an upper position and a lower position. When the lift plates 43 and 44 are at the upper position, the sheets placed on the lift plates 43, 44 abut on and cause the pick-up rollers 37, 34 to move upward, thereby allowing the pick-up rollers 37, 34 to feed a sheet. When the lift plates 43 and 44 are at the lower position, the sheets placed on the lift plates 43, 44 have receded downward from the upper position and are separated from the pick-up rollers 37, 34.

The following describes the movement of the lift plate 43, the holder 40 and the like in the first sheet feed cassette 31. It is noted that movements of the lift plate 44 and the like in the second sheet feed cassette 32 are the same as those of the lift plate 43 and the like, and description thereof is omitted. As shown in FIG. 6A, when the lift plate 43 is at the lower position, the holder 40 that supports the pick-up roller 37 and the sheet feed roller 38 is in a downward inclined attitude in which the pick-up roller 37 is positioned lower than the sheet feed roller 38.

As shown in FIG. 6B, when the lift plate 43 is at the upper position, the sheets stored in the first sheet feed cassette 31 raises the pick-up roller 37 upward. This allows the pick-up roller 37 to be displaced upward. At this time, the sheet can be fed by the pick-up roller 37 in the direction indicated by the arrow Y1. The fed sheet is nipped by the sheet feed roller 38 and the separation roller 39 in the nip portion N1.

In the present embodiment, a connection mechanism 100 (an example of the connection portion) is provided in such a way as to cause the conveyance unit 33 to be pulled out together with the first sheet feed cassette 31 when the first sheet feed cassette 31 is pulled out. This configuration prevents an increase in the cost as well.

The connection mechanism 100 connects the holder 40 with a lever member 102 (which is described below) so that swaying of the holder 40 enables the lever member 102 to be swayed. As shown in FIG. 4, the connection mechanism 100 is provided in the conveyance unit 33 at a position on the depth side in the insertion direction of the first sheet feed cassette 31. As shown in FIG. 5, the connection mechanism 100 includes an arm member 101, the lever member 102, a spring member 103 (biasing member), a spring supporting member 104, and a vertical wall portion 117. The arm member 101 extends from a predetermined position on the depth side of the holder 40, in a direction perpendicular to the rotation shaft 41. The vertical wall portion 117 is an example of the interruption portion of the present disclosure.

The lever member 102 is provided in the housing 36 of the conveyance unit 33. The lever member 102 extends parallel to the rotation shaft 41. The lever member 102 has a cylinder portion 107 at approximately the center thereof in the longitudinal direction. A pair of support walls 105 are provided to stand erect, facing each other, on the bottom surface of the housing 36. A swaying supporting shaft 106 is pivotably supported by the pair of support walls 105. The cylinder portion 107 of the lever member 102 is loosely fitted to the swaying supporting shaft 106. This allows the lever member 102 to be swayably supported.

The lever member 102 includes, on the front side of the cylinder portion 107 (left side in FIG. 5), a first flat plate portion 108, a second flat plate portion 109, a third flat plate portion 110, and a fourth flat plate portion 111 (a pressed surface). The arm member 101 is fitted in a space S surrounded by the first flat plate portion 108, second flat plate portion 109, and third flat plate portion 110. The lever member 102 is an example of the actuator member.

The spring supporting member 104 is provided in the housing 36 of the conveyance unit 33 at a position corresponding to the position of the fourth flat plate portion 111 of the lever member 102. The spring supporting member 104 includes a fifth flat plate portion 112, a sixth flat plate portion 113, and a seventh flat plate portion 114 and is thereby formed in a cross-sectional U-letter shape.

The spring supporting member 104 is attached, at the sixth flat plate portion 113 thereof, to the housing 36 of the conveyance unit 33. The fourth flat plate portion 111 of the lever member 102 is present between the fifth flat plate portion 112 and the sixth flat plate portion 113. In addition, the spring member 103 intervenes between the fifth flat plate portion 112 of the spring supporting member 104 and the fourth flat plate portion 111 of the lever member 102. The spring member 103 is provided in such a manner that when the lever member 102 is in a horizontal attitude, the spring member 103 is compressed and biases the fourth flat plate portion 111 of the lever member 102 downward. As a result, when the arm member 101 moves upward, the arm member 101 pushes up the lever member 102 on the second flat plate portion 109 while resisting against the biasing force of the spring member 103.

The lever member 102 includes an abutting portion 115 on the depth side of the cylinder portion 107. An engaged portion 116 (see FIG. 7) is formed on the abutting portion 115. The engaged portion 116 is in the shape of a projection that extends toward the depth side (right side in FIG. 5) from a lower part of the outer wall surface of a vertical wall 115A (abutting surface) positioned on the depth side of the contact portion 115.

Figure 8:
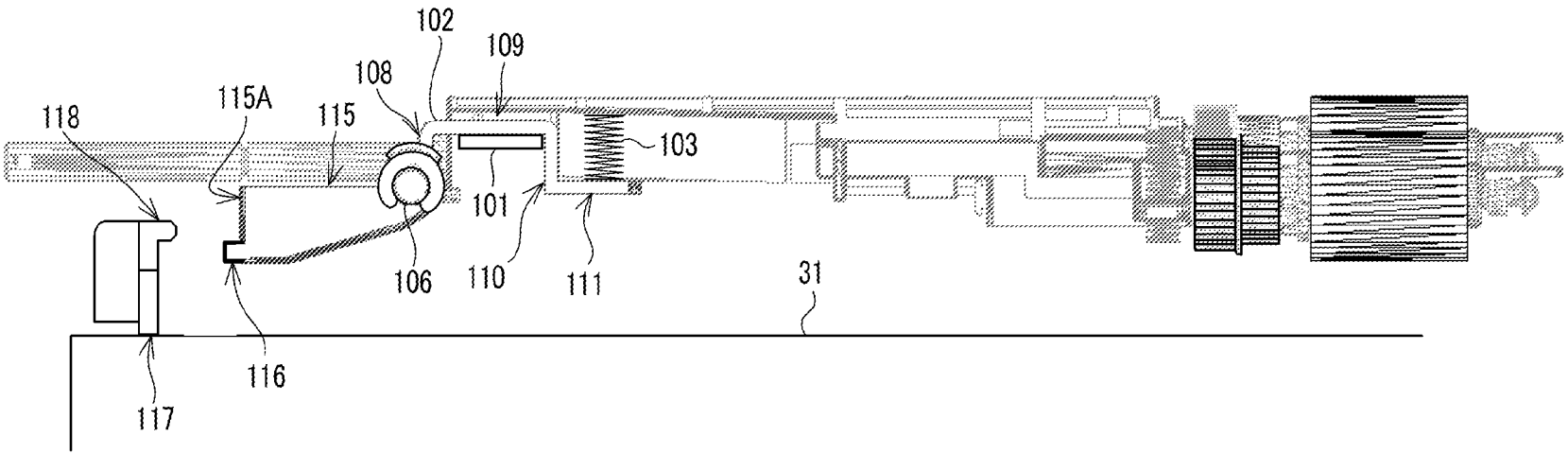
FIG. 8 is a side view of the connection portion when the lever member is in a horizontal attitude.

The vertical wall portion 117 (interruption portion) is provided in the first sheet feed cassette 31. As shown in FIG. 8, the vertical wall portion 117 is provided to be more on the depth side than the vertical wall 115A in such a way as to face the vertical wall 115A when the lever member 102 is in the horizontal attitude. An engaging portion 118 is provided on the upper end portion of the vertical wall portion 117, wherein the engaging portion 118 extends toward the vertical wall 115A.

With the above-described configuration, when the first sheet feed cassette 31 is pulled out, the conveyance unit 33 is pulled out together with the first sheet feed cassette 31.

Figure 7:
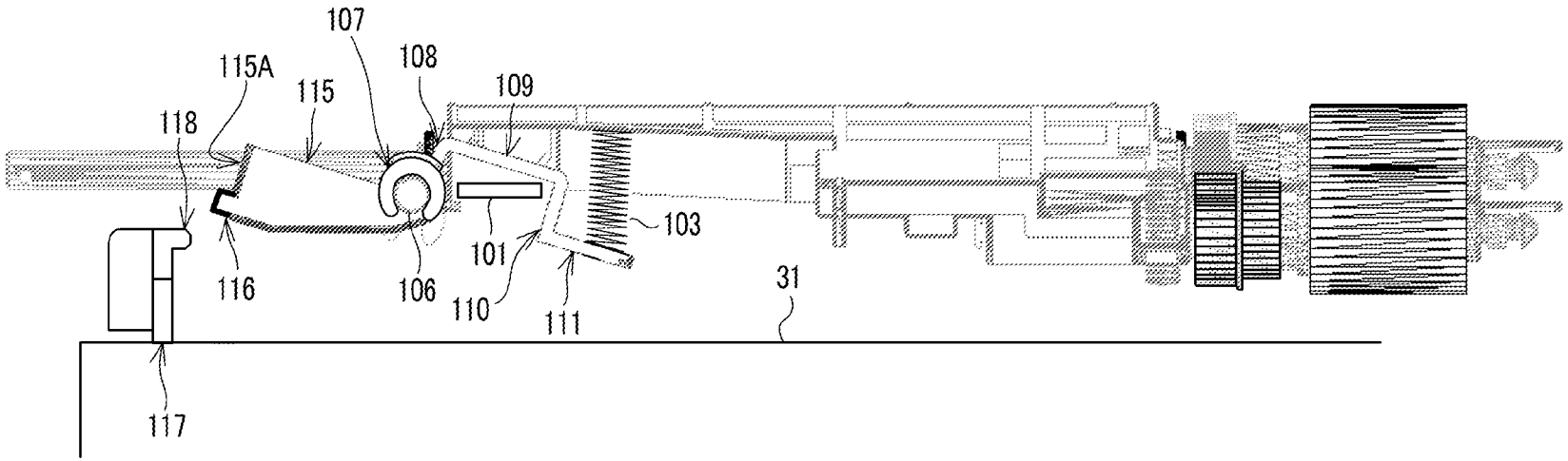
FIG. 7 is a side view of a connection portion when a lever member is in an inclined attitude.

That is, in the state where the pick-up roller 37 is not raised by the sheets within the first sheet feed cassette 31, the arm member 101 is inclined downward from the holder 40 side toward the lever member 102 side. At this time, as shown in FIG. 7, the lever member 102 is in such an attitude where the front side of the cylinder portion 107 is oriented downward and the depth side is oriented upward by the biasing force of the spring member 103. In addition, the depth-side end portion of the lever member 102 is higher in position than the upper end portion (engaging portion 118) of the vertical wall portion 117 provided in the first sheet feed cassette 31. As a result, when the first sheet feed cassette 31 is pulled out, the depth-side end portion of the lever member 102 does not abut on the first sheet feed cassette 31, and only the first sheet feed cassette 31 is pulled out.

Figure 9:
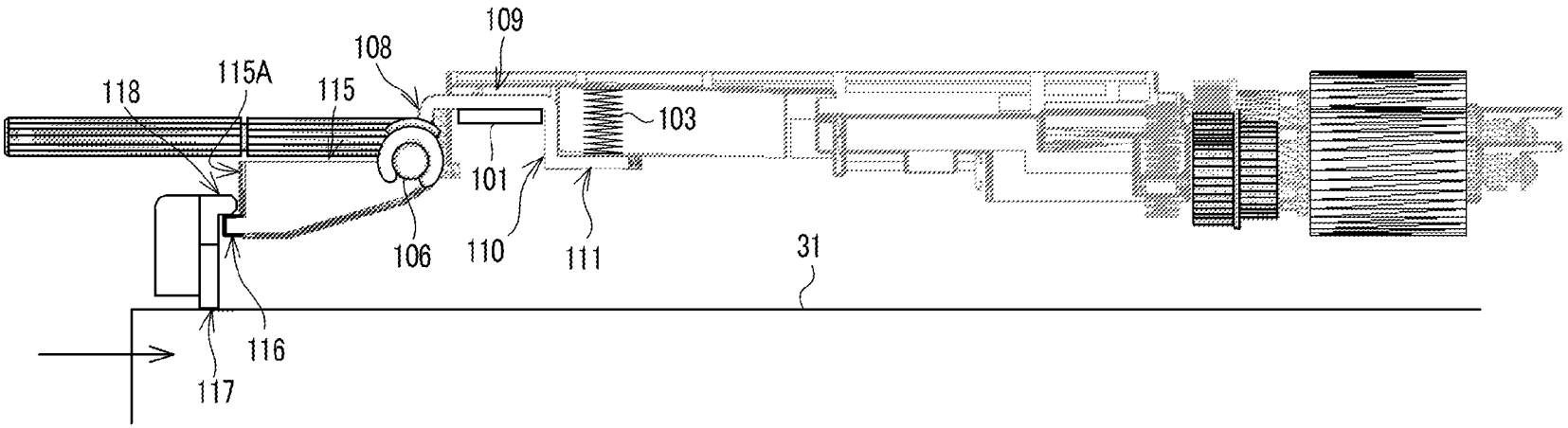
FIG. 9 is a side view of the connection portion when an engaged portion is engaged with an engaging portion.

In the state where the pick-up roller 37 is raised by the sheets within the first sheet feed cassette 31, the arm member 101 is inclined upward from the holder 40 side toward the lever member 102 side. This is the state where the conveyance unit 33 is attached to the first sheet feed cassette 31. In this state, the lever member 102 does not interrupt with the vertical wall portion 117, and is swayable. When the lift plate 43 is raised, the pick-up roller 37 applies a predetermined pressure to the sheets. As a result, as shown in FIG. 8, the lever member 102 is raised by the arm member 101 on the second flat plate portion 109 to be in the horizontal attitude, and the vertical wall 115A faces the vertical wall portion 117 of the first sheet feed cassette 31 across a predetermined gap. In addition, the engaged portion 116 of the vertical wall 115A of the lever member 102 becomes lower in position than the engaging portion 118 of the vertical wall portion 117. As a result, as shown in FIG. 9, when the first sheet feed cassette 31 is pulled out to a certain extent, the engaged portion 116 of the vertical wall 115A of the lever member 102 abuts on the wall surface of the vertical wall portion 117 of the first sheet feed cassette 31. In addition, the engaging portion 118 of the vertical wall portion 117 of the first sheet feed cassette 31 abuts on the wall surface of the vertical wall 115A of the lever member 102. As a result, when the first sheet feed cassette 31 is pulled out, the conveyance unit 33 is pulled out together with the first sheet feed cassette 31.

In this way, upon receiving a power that occurs due to the displacement of the pick-up roller 37 that is made by an upward movement of the lift plate 43, the connection mechanism 100 converts the power to a force that can displace the lever member 102 to a position where the vertical wall 115A faces the vertical wall portion 117 of the first sheet feed cassette 31 across a predetermined gap, and transmits the force to the lever member 102.

Here, in the present embodiment, when the first sheet feed cassette 31 is pulled out to a certain extent, the power transmission path between the lift plates 43, 44 and the driving motor 51 is cut. With this cut of the power transmission path, the arm member 101 attempts to be inclined downward from the holder 40 side toward the lever member 102 side. That is, due to the biasing force of the spring member 103, the lever member 102 attempts to take such an attitude where its part on the front side of the cylinder portion 107 is oriented downward and its part on the depth side of the cylinder portion 107 is oriented upward. However, since the engaged portion 116 is engaged with the engaging portion 118, even if the arm member 101 is inclined downward from the holder 40 side toward the lever member 102 side, the horizontal attitude of the lever member 102 is maintained. With this configuration, the conveyance unit 33 is pulled out together with the first sheet feed cassette 31, until the first sheet feed cassette 31 is pulled out to the limit of pulling out.

Figure 10:
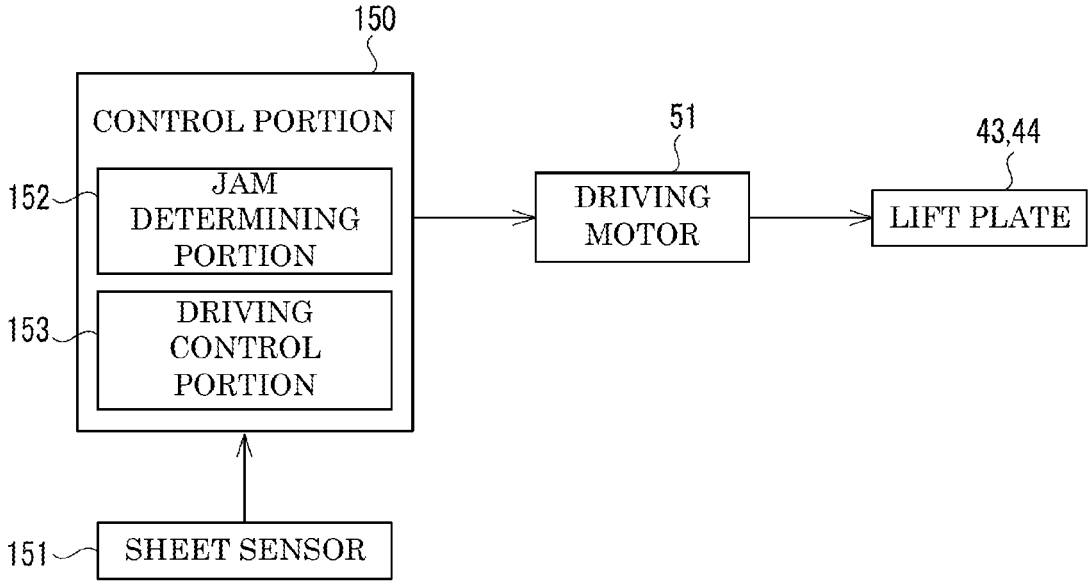
FIG. 10 is a diagram showing an electric configuration related to interlocking.

As shown in FIG. 10, the driving motor 51 is controlled by a control portion 150. The control portion 150 includes CPU, ROM, and RAM. The CPU is a processor for executing various types of arithmetic processes. The ROM is a nonvolatile storage portion in which various types of information such as control programs for causing the CPU to execute various types of processes are stored in advance. The RAM is a volatile storage portion, and is used as a temporary storage memory (working area) for the various types of processes executed by the CPU. The control portion 150 controls the operation of each component when the CPU executes the programs stored in the ROM.

Sheet sensors 151 are disposed at various points in the image forming apparatus 1. The sheet sensors 151 are electrically connected to the control portion 150. Each sheet sensor 151 includes a pair of light emitter and light receptor (not shown). In the present embodiment, a light-emitting diode is used as the light emitter, and a phototransistor is used as the light receptor. When a sheet passes through a detection area of the sheet sensor 151, light emitted from the light-emitting diode is reflected on the sheet, and the reflected light is received by the phototransistor. At this time, a light reception signal indicating reception of the reflected light is output from the phototransistor, and the light reception signal is received by the control portion 150 as a sheet detection signal. When there is no sheet in the detection area of the sheet sensor 151, it does not happen that light emitted from the light-emitting diode is reflected on the sheet, and the phototransistor receives no light. At this time, a non-light-reception signal, indicating that no reflected light has been received, is output from the phototransistor, and the non-light-reception signal is received by the control portion 150 as a non-sheet-detection signal.

As shown in FIG. 10, the control portion 150 realizes a jam determining portion 152 and a driving control portion 153 when the CPU executes the programs.

The jam determining portion 152 determines whether or not a jam occurred in the image forming apparatus 1, based on the output signals of the sheet sensors 151 disposed in the image forming apparatus 1. That is, when a sheet detection signal is not output from the sheet sensor 151 after a predetermined time has passed, the jam determining portion 152 determines that a jam occurred in the image forming apparatus 1.

The driving control portion 153 controls the operation of the driving motor 51 that drives the lift plates 43, 44 to be raised and lowered. When an image forming operation is performed, the driving control portion 153 controls the driving motor 51 in such a way as to raise the lift plates 43, 44 to a predetermined upper position. In addition, when the image forming operation is completed, the driving control portion 153 controls the driving motor 51 in such a way as to lower the lift plates 43, 44 to the lowest position. It is noted that the driving control portion 153 and the driving motor 51 are an example of the lifting portion of the present disclosure.

Meanwhile, if the lift plate 43 is lowered immediately after the jam determining portion 152 determines that a jam occurred, the engaging portion 118 is disengaged with the engaged portion 116, and the depth-side end portion of the lever member 102 does not face the vertical wall portion 117 of the first sheet feed cassette 31. That is, the vertical wall portion 117 and the lever member 102 are separated from each other by a predetermined distance. As a result, when the first sheet feed cassette 31 is pulled out, only the first sheet feed cassette 31 is pulled out. In that case, if a sheet stretches over the first sheet feed cassette 31 and the conveyance unit 33, the sheet would be torn apart since only the first sheet feed cassette 31 is pulled out.

To prevent the above-described problem, in the present embodiment, when the jam determining portion 152 determines that a jam occurred, the driving control portion 153 controls the driving motor 51 not to lower the lift plate 43. This maintains the horizontal attitude of the lever member 102, and maintains the state where the depth-side end portion of the lever member 102 faces the vertical wall portion 117 of the first sheet feed cassette 31. Thus when the first sheet feed cassette 31 is pulled out, the conveyance unit 33 is pulled out together with the first sheet feed cassette 31. It is therefore possible to prevent a sheet from being torn apart when the sheet stretches over the first sheet feed cassette 31 and the conveyance unit 33. It is noted that the driving control portion 153 may controls the driving motor 51 to lower the lift plate 43 after the first sheet feed cassette 31 and the conveyance unit 33 are pulled out to the limit of pulling out. To detect whether or not the first sheet feed cassette 31 and the conveyance unit 33 have been pulled out to the limit of pulling out, a sensor (not shown) may be used to detect whether or not the first sheet feed cassette 31 or the like has been pulled out. Alternatively, the following configuration is possible. That is, when a predetermined time has passed, it is determined that the first sheet feed cassette 31 and the conveyance unit 33 have been pulled out to the limit of pulling out, and the lift plate 43 is lowered.

Up to now, a preferable embodiment of the present disclosure has been described. However, the present disclosure is not limited to the above-described embodiment, but is applicable to various modifications.

A selection may be made between two states: a state in which, after both the conveyance unit 33 and the first sheet feed cassette 31 are pulled out forward, only the conveyance unit 33 can be returned (inserted) into the image forming apparatus 1; and a state in which both the conveyance unit 33 and the first sheet feed cassette 31 can be returned. For example, even after the conveyance unit 33 and the first sheet feed cassette 31 have been pulled out to the limit of pulling out, the driving control portion 153 does not lower the lift plate 43, and after a predetermined user operation is performed, it lowers the lift plate 43. In that case, when the user operation is performed, the conveyance unit 33 and the first sheet feed cassette 31 can be returned independently of each other; and when the user operation is not performed, both the conveyance unit 33 and the first sheet feed cassette 31 are returned together.

The connection mechanism 100 is not limited to the configuration described in the embodiment. For example, the engaging portion 118 and the engaged portion 116 may be omitted, and the vertical wall 115A of the conveyance unit 33 and the vertical wall portion 117 of the first sheet feed cassette 31 may be brought into a surface contact.

In addition, as another configuration of the connection mechanism 100, when the lever member 102 is in the horizontal attitude, the vertical wall 115A of the conveyance unit 33 and the vertical wall portion 117 of the first sheet feed cassette 31 may be connected with each other. In this configuration, the driving control portion 153 may lower the lift plate 43 immediately after a jam is detected because the conveyance unit 33 and the first sheet feed cassette 31 are integrated together even if the lift plate 43 is lowered.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a device main body;

a first sheet feed cassette configured to feed a sheet stored therein in a sheet feed direction in which the sheet is fed to the device main body and be inserted to and pulled out from the device main body in an insertion/pulling-out direction which intersects with the sheet feed direction;

a second sheet feed cassette disposed in alignment with the first sheet feed cassette on a downstream side thereof in the sheet feed direction and configured to be inserted into and pulled out independently from the device main body in the insertion/pulling-out direction;

a conveyance unit disposed above the first sheet feed cassette and the second sheet feed cassette in the device main body and configured to be inserted into and pulled out independently of the first sheet feed cassette and the second sheet feed cassette in the insertion/pulling-out direction and convey a topmost sheet of the sheets stored in the first sheet feed cassette toward a sheet conveyance path that is provided more on the downstream side in the sheet conveyance direction than the second sheet feed cassette;

a feed roller provided in the conveyance unit in such a way as to be displaced above the sheets stored in the first sheet feed cassette and feed the topmost sheet to the conveyance unit;

a lift plate having a sheet stacking surface on which the sheets stored in the first sheet feed cassette are placed, and configured to be raised and lowered between an upper position and a lower position, wherein when the lift plate is at the upper position, the sheets on the lift plate abut on the feed roller and the feed roller is allowed to feed the sheet, and when the lift plate is at the lower position, the sheets on the lift plate are separated from the feed roller;

a lifting portion configured to raise and lower the lift plate between the upper position and the lower position;

an interruption portion projecting from an upper part of the first sheet feed cassette; and an actuator member provided in the conveyance unit and configured to be displaced between a first position and a second position in conjunction with displacement of the feed roller, wherein the actuator member at the first position is allowed to contact the interruption portion, and the actuator member at the second position is separated from the interruption portion, wherein the conveyance unit is configured such that when the conveyance unit is pulled out in a state where the actuator member is at the first position, the actuator member and the interruption portion contact each other, and the conveyance unit is pulled out together with the first sheet feed cassette, and when the conveyance unit is pulled out in a state where the actuator member is at the second position, the actuator member does not contact the interruption portion, and the conveyance unit is pulled out independently of the first sheet feed cassette.

2. The sheet conveying device according to claim 1, wherein the actuator member is displaced to the first position in conjunction with displacement of the feed roller that is made by movement of the lift plate to the upper position, and is displaced to the second position in conjunction with displacement of the feed roller that is made by movement of the lift plate to the lower position.

3. The sheet conveying device according to claim 1, wherein the actuator member includes an abutting portion configured to abut on the interruption portion, and the interruption portion includes an engaging portion configured to be engaged with an engaged portion and keep the actuator member at the first position when the first sheet feed cassette is pulled out, the engaged portion being in a shape of a projection and provided on the abutting portion.

4. The sheet conveying device according to claim 3 further comprising a biasing member configured to bias the actuator member in a direction in which the abutting portion does not contact the interruption portion.

5. The sheet conveying device according to claim 1 further comprising:

a holder swayably supported on the conveyance unit and rotatably supporting the feed roller; and a connection portion connecting the holder with the actuator member so as to sway the the actuator member by swaying of the holder.

6. The sheet conveying device according to claim 5, wherein the connection portion is provided in the conveyance unit at a position on a depth side in an insertion direction in which the first sheet feed cassette is inserted into the device main body.

7. The sheet conveying device according to claim 1, wherein in a state where the conveyance unit and the first sheet feed cassette are attached in the device main body, the interruption portion and the actuator member are separated from each other by a predetermined distance.

8. An image forming apparatus comprising:

the sheet conveying device according to claim 1; and an image forming portion configured to form an image based on a sheet conveyed by the sheet conveying device from the first sheet feed cassette or the second sheet feed cassette.

* * * * *